United States Patent [19]

Braithwaite

[11] 4,223,871

[45] Sep. 23, 1980

[54] WINCH MECHANISM

[75] Inventor: John C. Braithwaite, Broughton-In-Furness, England

[73] Assignee: Vickers Shipbuilding Group Limited, Barrow-in-Furness, England

[21] Appl. No.: 26,675

[22] Filed: Apr. 3, 1979

[30] Foreign Application Priority Data

Apr. 4, 1978 [GB] United Kingdom ..... 13204/78

[51] Int. Cl.[3] ..... B66D 1/48

[52] U.S. Cl. ..... 254/291; 60/347

[58] Field of Search ..... 254/172, 175.5, 150 R, 254/150 FH, 158, 160

[56] References Cited

U.S. PATENT DOCUMENTS

| | | | |
|---|---|---|---|
| 3,481,584 | 12/1969 | Conry et al. | 254/172 |
| 3,817,033 | 6/1974 | Appel et al. | 60/444 |
| 4,025,055 | 5/1977 | Strolenberg | 254/172 |

*Primary Examiner*—Leonard D. Christian
*Attorney, Agent, or Firm*—Browdy and Neimark

[57] ABSTRACT

A winch mechanism of the surface compensating type for lifting objects from the surface of the sea comprises two or more variable pressure constant displacement hydraulic pump/motors coupled to drive a rope haulage mechanism; a pump connected for pumping operating fluid to the hydraulic pump/motors; a fluid accumulator branched from the high pressure fluid supply line from the pump to the pump/motors; and first and second non-return valves. The first non-return valve is in the high pressure fluid supply line between the fluid accumulator and the pump/motors to limit the flow of fluid from the accumulator to one only of the pump-/motors, and the second non-return valve is between the high pressure fluid line and a low pressure fluid return line to permit the other pump/motor(s) to act as a pump.

12 Claims, 3 Drawing Figures

WINCH MECHANISM

FIELD OF THE INVENTION

This invention relates to winch mechanisms and is particularly concerned with such mechanisms for use in lifting objects from the surface of the sea, and that are also suitable for use in towing at sea, or mooring.

DESCRIPTION OF THE PRIOR ART

When lifting an object located either on or beneath the surface of the sea by means of a rope hauled by a common winch mounted upon the deck of a ship that is heaving and pitching due to wave action, whatever the degree of resilience of the rope it is virtually impossible to avoid incurring resonance or rope snatch at some stage during the lift imparting violent motion to the object. This can severely overload the rope, or its attachment to the object being raised.

OBJECT OF THE INVENTION

It is an object of the present invention to provide a winch mechanism which overcomes the problems of the prior art mechanisms.

SUMMARY OF THE INVENTION

According to the present invention there is provided a winch mechanism comprising at least two variable pressure constant displacement hydraulic pump/motors coupled to drive a rope haulage mechanism; a pump connected for pumping operating fluid to the hydraulic pump/motors; a fluid accumulator branched from the high pressure fluid supply path from the pump to the pump/motors; and first and second non-return valves, the first non-return valve being in the high pressure fluid supply path between the fluid accumulator and the pump/motors to limit the flow of fluid from the accumulator to less than the total number of pump/motors, and the second non-return valve being between the high pressure fluid supply path and a fluid return path to permit the motor or motors not connected to the accumulator to act as a pump.

In such an arrangement, the provision of the first non-return valve minimises the capacity for the accumulator that is required to compensate for wave action (in the applications for the mechanism discussed above) when the demand from all motors exceeds the pump supply rate. The second non-return valve allows the (or each) remaining energised motor to act as a pump when, for example, a wave lifts an object being raised and as a result the energised motor(s) connected directly to the accumulator act(s) to drive the remaining non-energised motor(s).

In one embodiment, the mechanism comprises two hydraulic pump/motors, only one of which is connected to the high pressure accumulator.

In another embodiment, the mechanism comprises three hydraulic pump/motors, only one of which is connected to the high pressure accumulator.

The winch mechanism may include a further fluid accumulator branched from the fluid return path.

The motor or motors not connected to the high pressure accumulator may be connected to the pump via a reversing valve, whereby the motor or motors can drive the rope haulage mechanism so as to lower a rope. A stop valve, a pressure relief valve, and a non-return valve may be connected in parallel between the reversing valve and the motor or motors.

Alternatively, the mechanism may include a stop valve in series with the second non-return valve between the high pressure fluid supply path and the fluid return path to permit the motor or motors not connected to the high pressure accumulator to be operated as a pump when the output of the pump is reversed to drive the rope haulage mechanism so as to lower a rope. The mechanism may further include a stop valve in the fluid return path between the pump and the low pressure accumulator so as to isolate the accumulator during lowering. Further, a stop valve, a pressure relief valve, and a non-return valve may be provided in the high pressure path between the pump and the motor or motors not connected to the high pressure accumulator.

The rope haulage mechanism may comprise a plurality of pulleys drivingly connected to two or more of the hydraulic pump/motors, and a rope storage drum drivingly connected to a further hydraulic motor, a rope extending around the pulleys and to the storage drum.

Alternatively, the rope haulage mechanism may comprise a rope storage drum drivingly connected to one of the hydraulic pump/motors, a rope being secured to the storage drum.

As a further alternative, the rope haulage mechanism may comprise a plurality of pulleys drivingly connected to two or more of the hydraulic pump/motors, and a locker arranged below the pulleys, a rope extending around the pulleys and into the locker.

BRIEF DESCRIPTION OF THE DRAWINGS

For a better understanding of the invention and to show more clearly how it may be carried into effect, reference will now be made, by way of example, to the accompanying drawings, in which.

DESCRIPTION OF PREFERRED EMBODIMENTS

Figure 1:
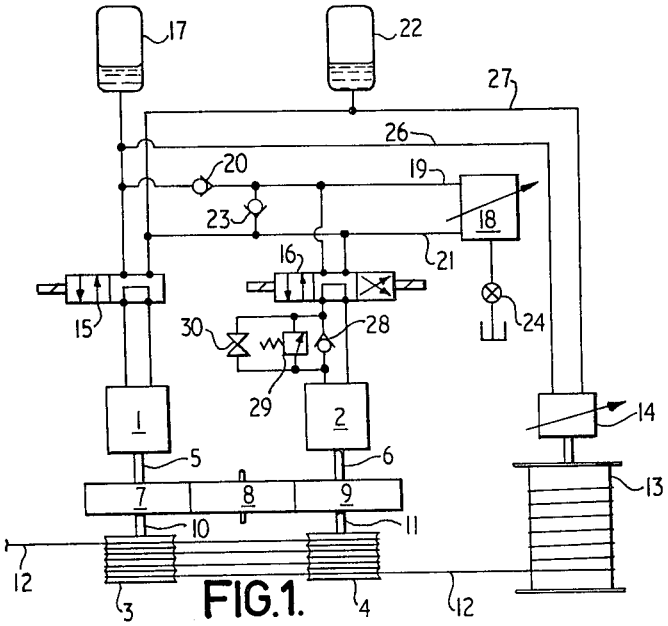
FIG. 1 is a diagram illustrating the basic components of a first form of winch mechanism.

In the winch mechanism of FIG. 1, two variable pressure fixed displacement hydraulic motors 1 and 2 drive multiple grooved pulleys 3 and 4 via shafts 5 and 6, intermeshing gears 7, 8 and 9, and shafts 10 and 11. A rope 12 whose free end is attached to the object being handled, traverses the pulleys 3 and 4, making a number of turns around each, and then passes to a storage drum 13 driven by an hydraulic motor 14. Alternatively, the pulleys 3 and 4 and the storage drum 13 with its drive motor 14 can be omitted and replaced by a winch barrel with a rope wound thereon, this barrel being directly driven from one of the gears 7, 8 or 9 (see FIG. 3).

Valves 15 and 16 control the motors 1 and 2, the valve 15 having an "off" position and one "on" position, and the valve 16 having an "off" position, a first "on" position and a second "on" position in which the fluid connections are reversed with respect to the first "on" position. These valves may be, for example, of the piston type, preferably pilot operated and may be manually operated, or pneumatically, electrically or hydraulically operated automatically either from visual (manual operation) or pressure sensor (automatic operation) signals obtained from a pressure gauge unit, the aim being to maintain a mean operating pressure as indicated by a gauge which ensures adequate fluid content of a high pressure accumulator 17. Valves 28, 29 and 30 are arranged in parallel in one of the lines between valves 16 and motor 2. Valve 28 is a non-return valve, valve 29 is a pressure relief valve, and valve 30 is a conventional shut-off valve.

Pressurisation equipment includes a conventional pump unit 18, which may be of fixed or variable delivery type as desired. Pump supply of fluid is via a high pressure line 19. The high pressure gas-hydraulic accumulator 17 is connected to this line 19 downstream of a non-return valve 20 to augment the supply of fluid only to the motor 1 (the non-return valve 20 preventing supply to the motor 2) when demand due to the downward motion of the ship relative to the object being handled exceeds the delivery rate of the pump unit 18. Fluid returns to the pump unit 18 via a low pressure line 21, a low pressure accumulator 22 storing excess fluid flowing via the motors 1 and 2 to accommodate a variable volume of fluid in what would otherwise be a constant volume system. A second non-return valve 23, between the lines 18 and 20, is positioned to permit the output of the motor 2 to pass to the high pressure line 18, whereby the motor 2 can act as a pump. The system is pressurised by means of a boost pump 24.

The storage drum drive motor 14 is energised from the high pressure accumulator 17 via the line 26 with return via line 27 to line 21. Advantageously the motor 14 is of the variable displacement type so that the torque applied to the rope 12 can be varied in the sense to maintain approximately constant tension in the rope 12 as the effective diameter of the drum 13 changes with change in the stored quantity of rope. Pump displacement control can be made automatic by sensing the quantity of rope stored, and transmitting an appropriate signal to pump displacement control equipment (not shown).

During hauling in of an object, the valve 15 is set to "on" and the valve 16 is set to "on" in the haul sense. With the two motors 1, 2 thus energised to haul in the rope 12, the non-return valve 20 acts to limit solely to the motor 1 unconditional access to a high pressure fluid supply, which, by itself, would be unable to sustain the whole weight of the object in air, but exerts sufficient torque to maintain some tension in the rope 12, thereby preventing snatch from occurring. Fluid from pump 18 passes to motor 2 by way of the high pressure fluid supply line 19, valve 16 and non-return valve 28, valves 29 and 30 being closed. The motor 1 may overdrive the other motor 2, the fluid requirements of motor 2 in excess of that supplied by the pump unit 18 being provided by recirculation around a closed loop through the non-return valve 23. Thus, in use with equipment mounted on a ship and the rope 12 attached to an object to be lifted from the surface of the sea, wave induced motion of the ship (or other platform upon which the winch and its drive mechanisms are mounted), is superimposed upon the lift motion effected by the winch by supplying the transient hydraulic fluid demand from the precharged gas hydraulic accumulator 17 as the ship falls relative to the load. However, when the ship rises again, non-return valve 28 and pump 18 prevent the motor 2 running in reverse and, by means of gears 7, 8, 9 also prevents motor 1 running in reverse. Thus, as the ship rises, the load also rises.

Lowering of an unloaded rope is accomplished by setting the valve 16 to its other "on" position, thus reversing the supply of hydraulic fluid to the motor 2, the hydraulic fluid flowing through the open valve 30, and setting the valve 15 to "off" so that the other motor 1 is allowed to idle. The valve 20 serves to prevent unloading of the accumulator.

Lowering under load is also accomplished by setting the valve 16 to its other "on" position thus reversing the supply of hydraulic fluid to motor 2 and by setting valve 15 to its "off" position so that the motor 1 is allowed to idle. However, when lowering under load, valve 30 is closed and the pressure relief valve 29 is set so that the pressure generated due to the load being supported is insufficient to actuate the pressure relief mechanism. However, when the pump 18 is operated, pressure builds up until, at a predetermined pressure depending upon the load (but greater than that generated by the load), the valve 29 allows hydraulic fluid to flow. This permits the load to be lowered until the pressure falls below the predetermined value, that is under the control of the valve 29.

It is, of course, possible to provide more than one motor 2 and, in such a case, only as many motors as are needed to take the load are energised.

When a load has been lowered to the surface of the sea, or is about to be lifted from the surface, it is desirable to allow the load to remain on the surface of the sea in a buoyant condition with the rope 12 taut. This is achieved in the embodiment of FIG. 1 by opening the valve 30, stopping the pump 18, and setting the valve 16 to the "off" position. This permits the motor 2 to idle, but hydraulic fluid is able to pass between the high pressure accumulator 17 and the low pressure accumulator 22 via the motor 1, so that the pressure in the high pressure accumulator 17 is able to maintain the rope taut but is unable to support the weight of the load in air. Thus, as the ship falls, fluid is passed from the high pressure accumulator to the low pressure accumulator and rope is taken in, whereas, as the ship rises, fluid passes from the low pressure accumulator to the high pressure accumulator and rope is paid out.

When the load is to be lifted from the surface of the sea, pump 18 is started and valve 30 is closed to prevent the load falling back as a wave recedes.

Figure 2:
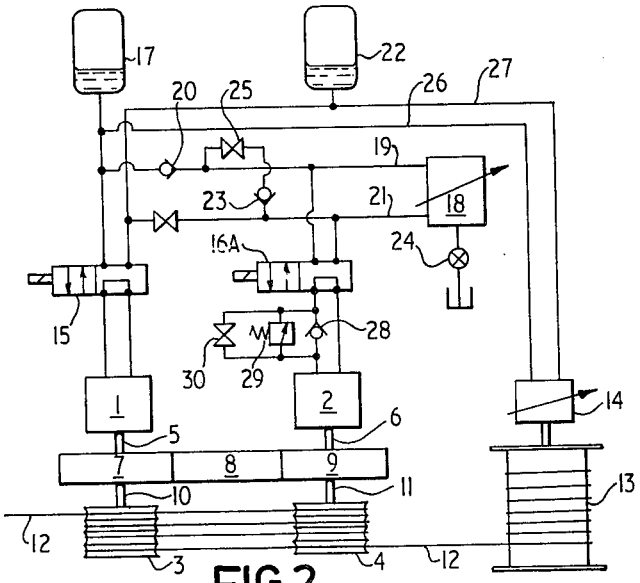
FIG. 2 is a similar diagram illustrating the basic components of a second form of winch mechanism.

The winch mechanism of FIG. 2 is, in the main, the same as that of FIG. 1 and like reference numerals indicate like parts. In this mechanism, the valve 16 is replaced by a valve 16A which is the same as the valve 15, having only one "on" position, and the valve 23 is connected to the high pressure line 19 through a stop valve 25. In addition, a shut-off valve 31 is provided in the low-pressure line 21 for isolating the low pressure accumulator 22 when lowering. Lowering of an unloaded rope or under load, is accomplished in this embodiment by setting the valve 15 to "off", the valve 16A to "on", closing the valves 25 and 31 and reversing the output of the pump unit 18. As the pressure builds up, pressure relief valve 29 (which may be set to different values depending on whether or not a load is to be lowered) is triggered and fluid flows from the pump 18, along line 21, through valve 16A, motor 2, valve 29, back through valve 16A to line 19, and back to the pump 18. Non-return valve 20 prevents unloading of accumulator 17, and stop valve 31 is closed to isolate the low pressure accumulator 17 from what is now high pressure fluid in line 21.

In each form described more than two motors and associated on/off valves can be provided, with the non-return valve 20 positioned to limit flow of fluid from the accumulator to less than the total number of motors energised.

While in both the embodiments of FIGS. 1 and 2 the rope is stored on a separate drum 13, some ropes are better stroed in a locker. For this purpose, both drum 13 and motor 14 may be omitted, and instead a locker may be provided beneath the pulleys 3, 4 for storing the rope. With locker storage, the vertical fall of the rope between the pulleys 3, 4 and the locker would maintain sufficient tension in the rope to prevent slipping.

Figure 3:
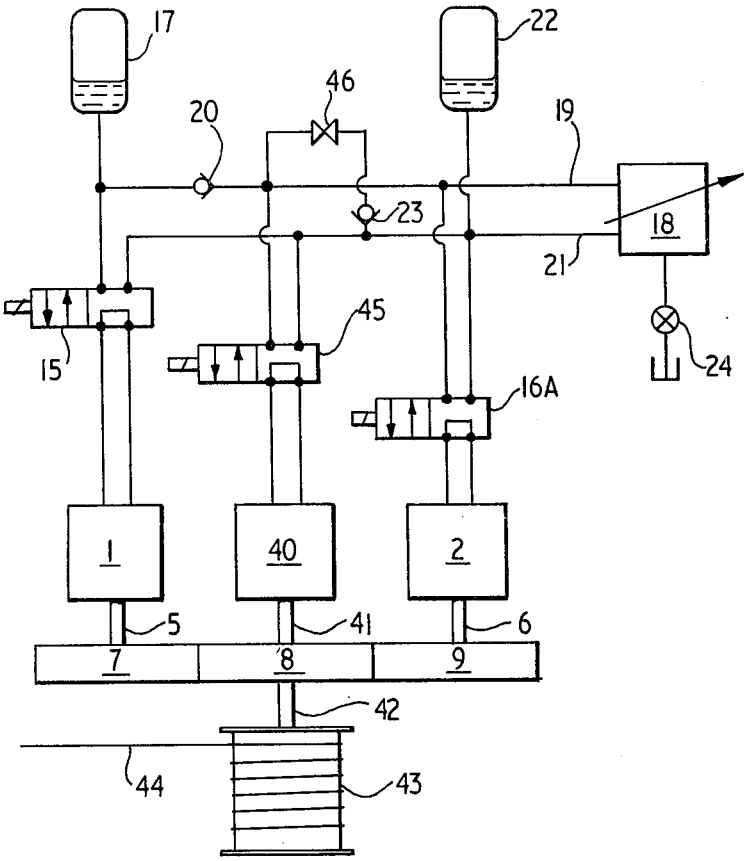
FIG. 3 is a diagram, similar to FIGS. 1 and 2, illustrating the basic components of a third form of winch mechanism.

In FIG. 3 the same reference numerals have been used where possible as in FIG. 2. In the embodiment of FIG. 3, an additional constant displacement motor 40 is coupled to gear 8 by means of a shaft 41 and drives a single winch drum 43 by way of a shaft 42 to haul in or pay out a rope 44.

Motor 40 is controlled by a valve 45 having an "off" position and one "on" position. The valve may be of the same type as valves 15 and 16A. In addition, non-return valve 23 is connected to the high pressure line 19 by way of a shut-off valve 46.

As the ship falls relative to the load, motor 1 is able to overrun motors 2 and 40 with non-return valve 20 limiting access of fluid from accumulator 17 solely to motor 1 as in the embodiments of FIG. 1 and 2. However, as the ship begins to rise again fluid from pump 18 prevents the motors running in reverse. Thus, as the ship rises, the load also rises.

Lowering of an unloaded rope or under load is accomplished by setting the valve 15 to "off", setting as many as necessary of valves 16A and 45 to "on", closing valve 46, and reversing the output of pump unit 18. If necessary or if desired, as in the embodiment of FIG. 2, a valve may be included to isolate the low pressure accumulator 22 during lowering.

The winch mechanisms described above can also be used for towing at sea, or mooring.

I claim:

1. A winch mechanism comprising:

a rope haulage mechanism;

at least two variable pressure constant displacement hydraulic pump/motors coupled to drive the rope haulage mechanism;

a pump for pumping operating fluid to the hydraulic pump/motors;

a high pressure fluid supply line connecting the pump to the hydraulic pump/motors;

a fluid return line for returning fluid from the hydraulic pump/motors to the pump;

a fluid accumulator branched from the high pressure fluid supply line;

a first non-return valve in the high pressure fluid supply line between the fluid accumulator and the pump/motors for limiting the flow of fluid from the accumulator to less than the total number of pump/motors; and a second non-return valve between the high pressure fluid supply line and the fluid return line to permit the motor or motors not connected to the accumulator to act as a pump.

2. A winch mechanism as claimed in claim 1, wherein the mechanism comprises two hydraulic pump/motors, only one of which is connected to the accumulator.

3. A winch mechanism as claimed in claim 1, wherein the mechanism comprises three hydraulic pump/motors, only one of which is connected to the accumulator.

4. A winch mechanism as claimed in claim 1 and including a further fluid accumulator branched from the fluid return line.

5. A winch mechanism as claimed in claim 4 and including a stop valve in series with the second non-return valve between the high pressure fluid supply line and the fluid return line to permit the motor or motors not connected to the high pressure accumulator to be operated as a pump when the output of the pump is reversed to drive the rope haulage mechanism so as to lower a rope.

6. A winch mechanism as claimed in claim 5 and including a stop valve in the fluid return line between the pump and the low pressure accumulator so as to isolate the accumulator during lower.

7. A winch mechanism as claimed in claim 5 and including a stop valve, a pressure relief valve, and a non-return valve in the high pressure line between the pump and the motor or motors not connected to the high pressure accumulator.

8. A winch mechanism as claimed in claim 1 wherein the motor or motors not connected to the accumulator is connected to the pump via a reversing valve, whereby the motor or motors can drive the rope haulage mechanism so as to lower a rope.

9. A winch mechanism as claimed in claim 8 and including a stop valve, a pressure relief valve, and a non-return valve connected in parallel between the reversing valve and the motor or motors.

10. A winch mechanism as claimed in claim 1, wherein the rope haulage mechanism comprises a plurality of pulleys drivingly connected to two or more of the hydraulic pump/motors, and a rope storage drum drivingly connected to a further hydraulic motor, a rope extending around the pulleys and to the storage drum.

11. A winch mechanism as claimed in claim 1, wherein the rope haulage mechanism comprises a rope storage drum drivingly connected to one of the hydraulic pump/motors, a rope being secured to the storage drum.

12. A winch mechanism as claimed in claim 1, wherein the rope haulage mechanism comprises a plurality of pulleys drivingly connected to two or more of the hydraulic pump/motors, and a locker arranged below the pulleys, a rope extending around the pulleys and into the lockers.

* * * * *